US005599280A

United States Patent [19]

Wolden

[11] Patent Number: 5,599,280

[45] Date of Patent: Feb. 4, 1997

[54] THERAPEUTIC WRIST DEVICE HAVING VIBRATION AND HEAT

[76] Inventor: Wallace W. Wolden, 50 Sunbeam La., Reno, Nev. 89511

[21] Appl. No.: 407,140

[22] Filed: Mar. 20, 1995

[51] Int. Cl.[6] ..... A61H 1/00

[52] U.S. Cl. ..... 601/15; 248/918; 601/57

[58] Field of Search ..... 601/15, 56, 57–60, 601/64, 66–70, 78; 248/118, 118.1, 118.3, 918

[56] References Cited

U.S. PATENT DOCUMENTS

| | | | |
|---|---|---|---|
| 3,885,553 | 5/1975 | Vecchio | 601/57 X |
| 3,981,032 | 9/1976 | Brooks | 601/57 X |
| 5,020,517 | 6/1991 | Foster, Jr. et al. | 601/57 |
| 5,040,757 | 8/1991 | Benaway | 248/918 X |
| 5,140,976 | 8/1992 | Cheng | 601/57 |
| 5,181,504 | 1/1993 | Ono et al. | 601/57 X |
| 5,188,095 | 2/1993 | Healy | 601/59 X |
| 5,356,099 | 10/1994 | Sereboff | 248/918 X |
| 5,374,018 | 12/1994 | Daneshvar | 248/918 X |
| 5,398,896 | 3/1995 | Terbrack | 248/918 X |
| 5,429,585 | 7/1995 | Liang | 601/57 X |
| 5,467,950 | 11/1995 | Dumitru | 601/128 X |
| 5,478,034 | 12/1995 | Cunningham et al. | 248/918 X |

FOREIGN PATENT DOCUMENTS

| | | | |
|---|---|---|---|
| 86003109 | 6/1986 | WIPO | 601/57 |

*Primary Examiner*—Robert A. Hafer
*Assistant Examiner*—Brian E. Hanlon

[57] ABSTRACT

A therapeutic wrist device is provided having a body made of foam or other soft material. At least one cavity is provided in the body for housing an electrical vibrating device. Electrical heating elements are also incorporated in the body. A control unit is provided for controlling the vibrating devices and heating elements. The wrist device may be used with a computer keyboard and one mode of operation elevates the side of the keyboard closest to the user so that the keyboard slopes away from the user.

1 Claim, 2 Drawing Sheets

THERAPEUTIC WRIST DEVICE HAVING VIBRATION AND HEAT

FIELD OF THE INVENTION

The invention relates generally to the aiding of ailing wrists, hands and fingers.

BACKGROUND OF THE INVENTION

The computer-keyboard industry has exploded worldwide. In the United States of America, the computer-keyboard industry is second to none.

Along with this mass of new and newer computer-keyboard technology and equipment, come problems for the day-to-day operators of said equipment.

The continuous operation of using a keyboard carries a toll. There are wide-spread complaints of injuries due to the repetitious use of keyboards.

Others have taken the approach that wrist pads should be of a particular height. Some have wrists resting on particular types and textures of foam pads.

Still others have developed what might be called a computer work station.

OBJECTIVES OF THE INVENTION

The first objective of the invention is to reduce the pain and suffering and disability sustained by the computer/keyboard operator.

The second objective is to reduce or eliminate medical costs incurred by both the user and/or the employee due to injuries sustained by repetitious use of computers and/or keyboards.

The third objective is to resume normal or higher productivity.

Applicant's invention overcomes the inadequacies of simply resting the wrist on a wrist pad.

SUMMARY OF THE INVENTION

The device is a rectangular-shaped padded cushion placed in front of a computer keyboard, or any other type of equipment requiring the continuous and repetitious use of the wrists, hands and fingers.

The device requires electrical power, namely 110 volts. It can also use a low voltage transformer. In addition, the device can be adopted directly to computers. When said device is connected and turned on, it will produce a massage and/or heat to comfort the wrists, hands, fingers of the operator.

DESCRIPTION OF THE PREFERRED EMBODIMENTS

Figure 1:
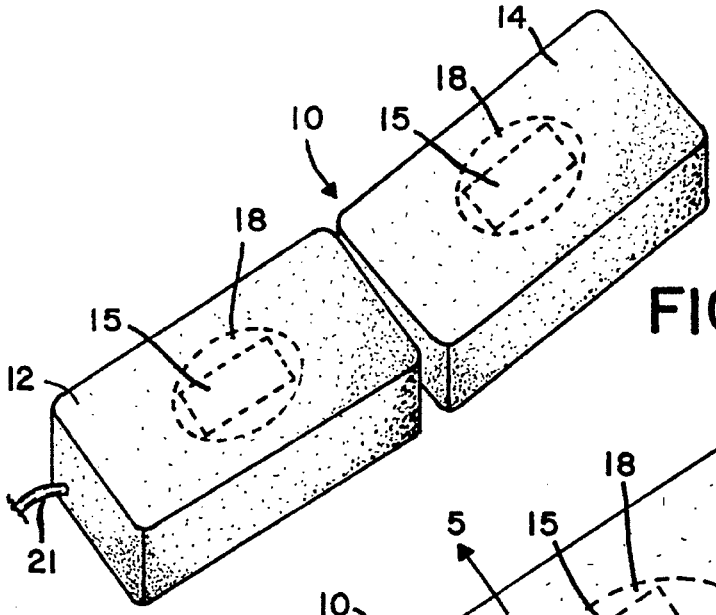
FIG. 1 is a perspective view of one embodiment of the wrist device.

FIG. 1 shows one embodiment of a therapeutic wrist device 10 of the present invention. In this embodiment the wrist device may comprise two segments; a left segment 12 and a right segment 14. A user may place his wrist on the upper surface of the device while performing some task, such as typing on a computer keyboard, or while resting. An electrical cord 21 provides electrical power to operate internal heating elements and vibrating devices 15. An internal cavity 18 is provided in each segment for housing the heating elements and vibrating devices.

Figure 2:
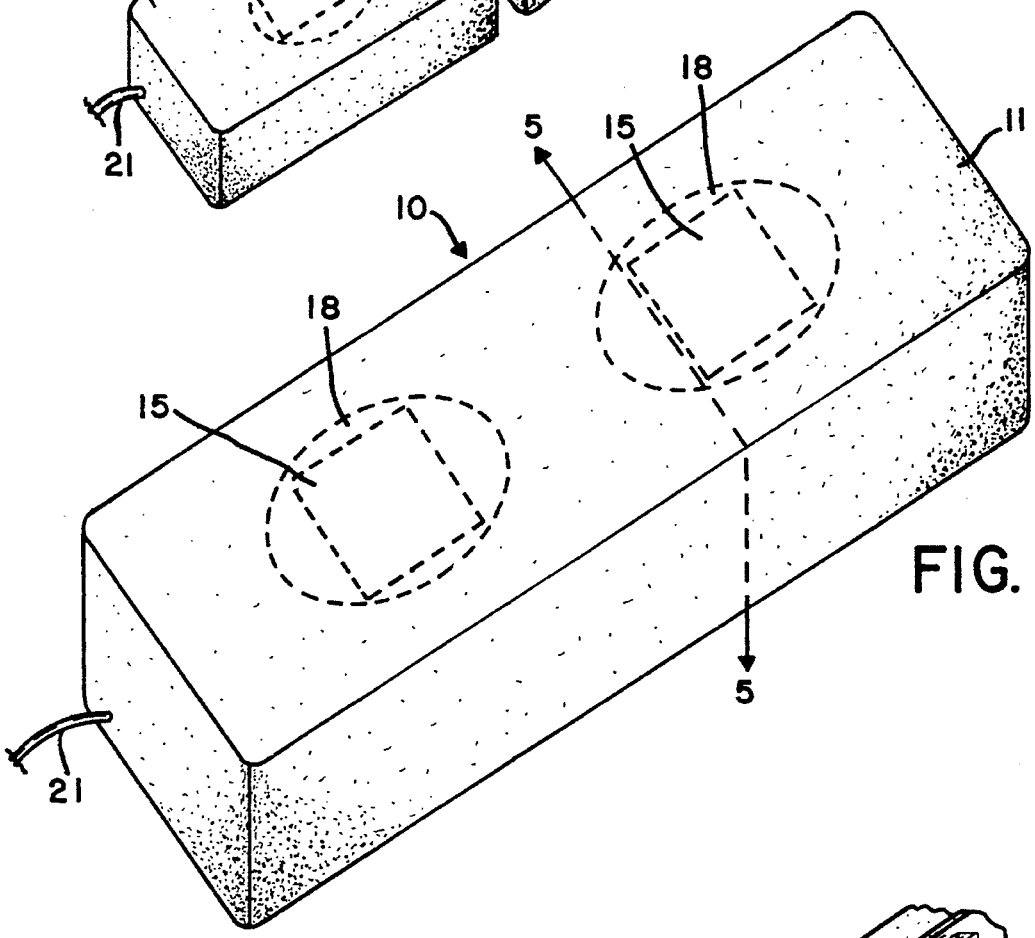
FIG. 2 is a perspective view of another embodiment of the wrist device.

FIG. 2 shows another embodiment of the present invention where the therapeutic wrist device 11 comprises a single unit. Electrical cord 21, vibrating device 15, and internal cavities 18 are also provided in this embodiment.

Figure 3:
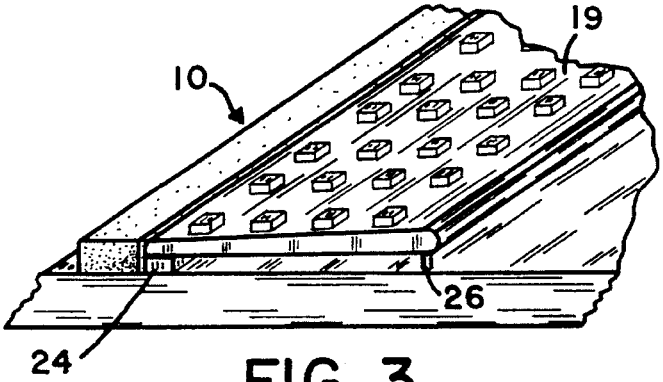
FIG. 3 is a perspective view of another embodiment of the wrist device in one mode of operation.

FIG. 3 shows an embodiment of the present invention in use with a computer keyboard 19. In this embodiment keyboard 19 is raised by a support 24 whereby the upper surface of keyboard 19 is substantially equal to the upper surface of the wrist device 13. The longitudinal length of wrist device 13 is also substantially the same as the longitudinal length of keyboard 19.

Wrist device 13 may be formed from a moldable high density soft foam or a rigid expandable type foam. Other materials may also be used to fashion the device. Wrist device 13 is covered in a smooth material that is capable of being removed to expose the vibrating devices and heating elements.

Figure 4:
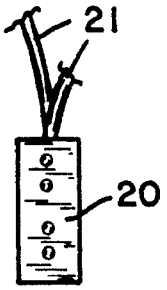
FIG. 4 is a plan view of the control unit of the wrist device.

FIG. 4 shows a control unit 20 and electrical cord 21 of the invention. Control unit 20 comprises switches for controlling the electrical power to the heating elements and vibrating devices.

Figure 5:
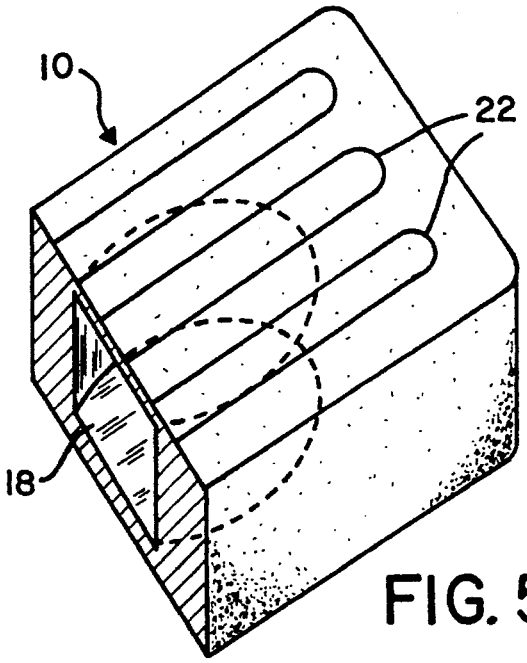
FIG. 5 is a perspective cross sectional view of one embodiment of the wrist device along line 5 of FIG. 2.

FIG. 5 is a cross sectional perspective view of therapeutic wrist device 11 along line 5 of FIG. 2. The invention is shown without its outer coveting thereby revealing some of the internal elements of the invention. An internal cavity 18 is provided for housing a vibrating device. The vibrating device may be any of a number of vibrating devices that are well known in the an. Heating elements 22 are provided and maybe embedded in the upper surface of the wrist device 11. A plurality of heating elements 22 provide therapeutic heat to the user's wrists and they are of a type that is well known in the art.

Figure 6:
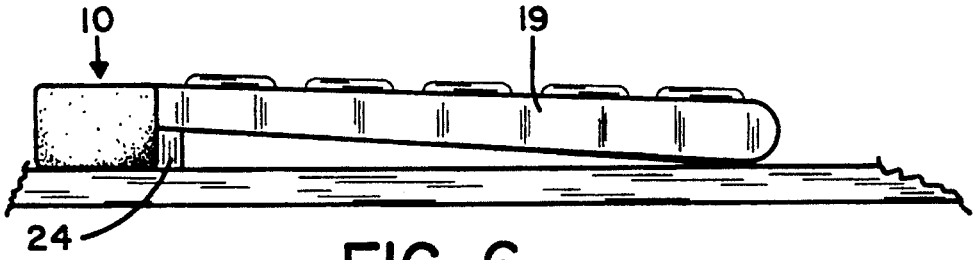
FIG. 6 is a side view of one embodiment of the wrist device in one mode of operation with a computer keyboard.
Figure 7:
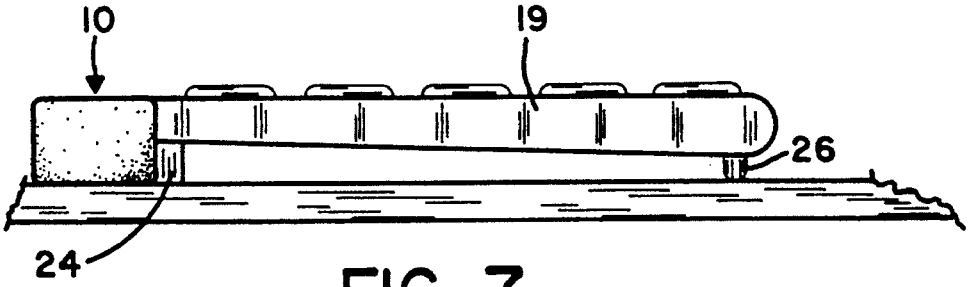
FIG. 7 is a side view of one embodiment of the wrist device in another mode of operation with a computer keyboard.

FIG. 6 depicts one mode of operation of therapeutic wrist device 13 with keyboard 19 and support 24. In this mode, support 24 raises the side of keyboard 19 that is closest to the user and keyboard 19 slopes downward away from the user. In normal operation, the user would place his wrists on wrist device 13 and his fingers would strike keys on keyboard 19. It had been determined that this configuration reduces stress and increases the comfort of the user. FIG. 7 shows an alternative mode of operation. Keyboard 19 is raised by a support leg thereby making keyboard 19 substantially level or with a slight upward angle.

What is claimed and desired to be protected by Letters Patent of the United States is:

1. A therapeutic wrist device in combination with a computer keyboard, said wrist device of said combination comprising:

(a) a body for supporting a person's wrists during the operation of said computer keyboard, said body being formed of soft material and having a substantially rectangular shape, said body being positioned in close relative proximity to said computer keyboard whereby the person may operate said computer keyboard when the person's wrists are supported by said body, (b) vibrating means located within a cavity within said body for providing physical stimulation to the person's wrists, and (c) heating means located within said body for providing thermal stimulation to the person's wrists.

* * * * *